US005390735A

United States Patent [19]

Williamson, Jr.

[11] Patent Number: 5,390,735

[45] Date of Patent: * Feb. 21, 1995

[54] FULL BORE LOCK SYSTEM

[75] Inventor: Jimmie R. Williamson, Jr., Carrollton, Tex.

[73] Assignee: Halliburton Company, Houston, Tex.

[ * ] Notice: The portion of the term of this patent subsequent to Sep. 20, 2011 has been disclaimed.

[21] Appl. No.: 986,308

[22] Filed: Dec. 7, 1992

Related U.S. Application Data

[63] Continuation-in-part of Ser. No. 933,668, Aug. 24, 1992, Pat. No. 5,348,087.

[51] Int. Cl.[6] ..... E21B 23/02

[52] U.S. Cl. ..... 166/115; 166/134; 166/214; 166/217; 166/237

[58] Field of Search ..... 166/115, 214, 217, 242, 166/134, 237, 123

[56] References Cited

U.S. PATENT DOCUMENTS

| | | | |
|---|---|---|---|
| Re. 26,319 | 12/1967 | Tamplen | 166/115 |
| 2,862,564 | 12/1958 | Bostock | 166/214 |
| 3,507,329 | 4/1970 | Stone, Jr. | 166/214 |
| 4,161,984 | 7/1979 | Watkins | 166/217 X |
| 4,540,048 | 9/1985 | Gazda | 166/214 |

*Primary Examiner*—Hoang C. Dang
*Attorney, Agent, or Firm*—Tracy W. Druce; Craig M. Lundell

[57] ABSTRACT

A locking system which includes landing nipples connectable in a well flow conduit and a lock mandrel to which well flow control devices are connectable. The landing nipples have an unrestricted full bore flow passage with a locking groove and profiled locating recesses with one square shoulder in the flow passage. The lock mandrel may be lowered through full bore landing nipples to automatically locate in the full bore landing nipple in which the lock mandrel is to be operated to lock and expand a seal system to sealingly engage the landing nipple. The lock mandrel utilizes locking lugs engageable in the landing nipple locking grooves. The automatic locator device has locating keys with one or two square shoulders, which locate the lock mandrel in a landing nipple. After operating, the lock mandrel is releasably retained locked and sealed in the landing nipple. The lock mandrel may be operated to disengage the landing nipple and permit the seal system to retract for retrieval from the landing nipple.

17 Claims, 5 Drawing Sheets

FULL BORE LOCK SYSTEM

This application is a continuation-in-part of my application for patent filed Aug. 24, 1992, Ser. No. 07/933,668, now the U.S. Pat. No. 5,348,087.

BACKGROUND

1. Field

This invention pertains to locking systems useful to position flow control devices in well flow conduits.

2. Information

A number of locking systems have been developed which employ landing nipples spaced apart in well flow conduits and lock mandrels, with flow controls connected, which locate, releasably lock and seal in a selected one of the landing nipples. The landing nipples used in existing systems either contain a restriction or a "square shoulder" to enable selection and location of a particular landing nipple in a well conduit in which the lock mandrel is to be operated to lock and seal. A square shoulder is created by a surface perpendicular to and intersecting the longitudinal flow passage through a landing nipple. A restriction in a landing nipple undesirably reduces the through flow passage area to create a shoulder on which a lock mandrel may locate. A very limited number of restricted bore landing nipples can be utilized in a well flow conduit. If the landing nipple is "full bore" and not restricted, it usually has profiled recesses in which the lock mandrel may locate. Lock mandrels and well tools moved downwardly or upwardly through landing nipples often hang on restricting shoulders which may be eroded and create flow turbulence that possibly aids undesirable deposition of hard scale in the landing nipple.

SUMMARY OF THE INVENTION

The locking system of this invention provides a full bore landing nipple having an unrestricted through flow passage equal in diameter to or larger than the internal diameter of the well flow conductor. A locking groove and profiled locating recesses in the landing nipple contain one square shoulder. Twenty or more full bore landing nipples may be installed in a well flow conduit. The lock mandrel contains an expandable seal system and a locating device having keys which are engageable in the landing nipple locating recesses. The locating device automatically selects, locates and engages the locating recesses in any one of the full bore landing nipples in which the lock mandrel is to be operated to lock and seal. The keys on the locating device have one or two square shoulders and the lock mandrel may be operated to unlock, permitting the seal system to contract for retrieval of the lock mandrel from a full bore landing nipple to surface.

An object of this invention is to provide a locking system for well flow controls wherein the landing nipple is unrestricted and full bore and has the same minimum inside diameter as the well flow conduit into which it is connected.

An object of this invention is to provide a locking system wherein the full bore landing nipples contain an internal locking groove and profiled locating recesses which have one square shoulder.

Another object of the present invention is to provide a locking system which utilizes a locking mandrel to which a number of different flow controls may be connected.

Another object of the present invention is to provide a locking system in which twenty or more full bore landing nipples may be connected in a well flow conduit.

Also an object of the present invention is to provide a lock mandrel which automatically locates and may be operated to lock and seal in any one of a number of full bore landing nipples in a well flow conduit.

Also an object of this invention is to provide a lock mandrel having a locating device with one or two square shoulders which is disengaged from a full bore landing nipple by pulling on the lock mandrel.

DESCRIPTION OF THE PREFERRED EMBODIMENT

Figure 1A:
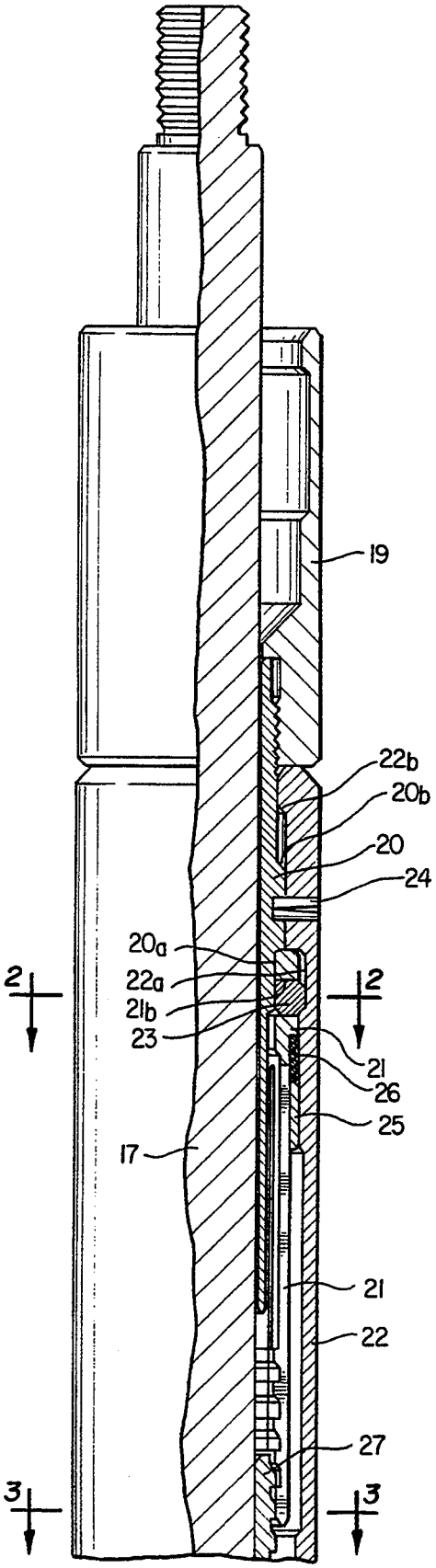
FIGS. 1A, 1B and 1C are a drawing in elevation and half section of the invention system showing the lock mandrel, with attached flow control, located for locking and sealing in a full bore landing nipple.
Figure 1B:
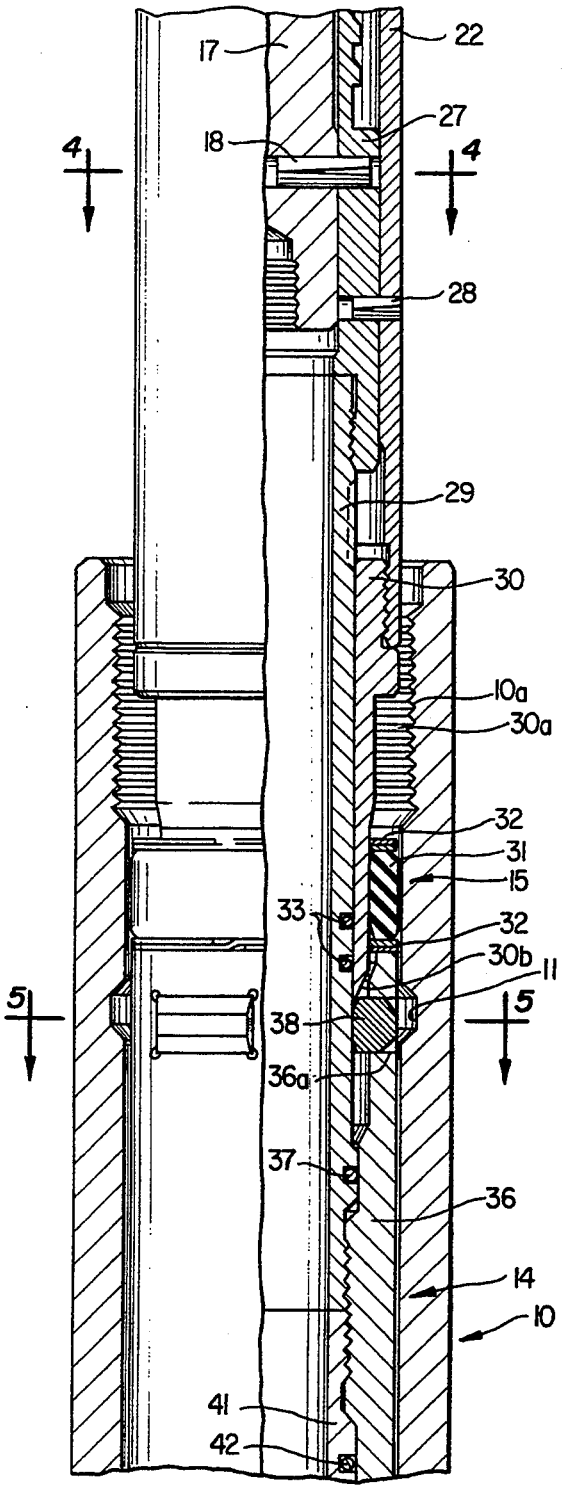
Figure 1C:
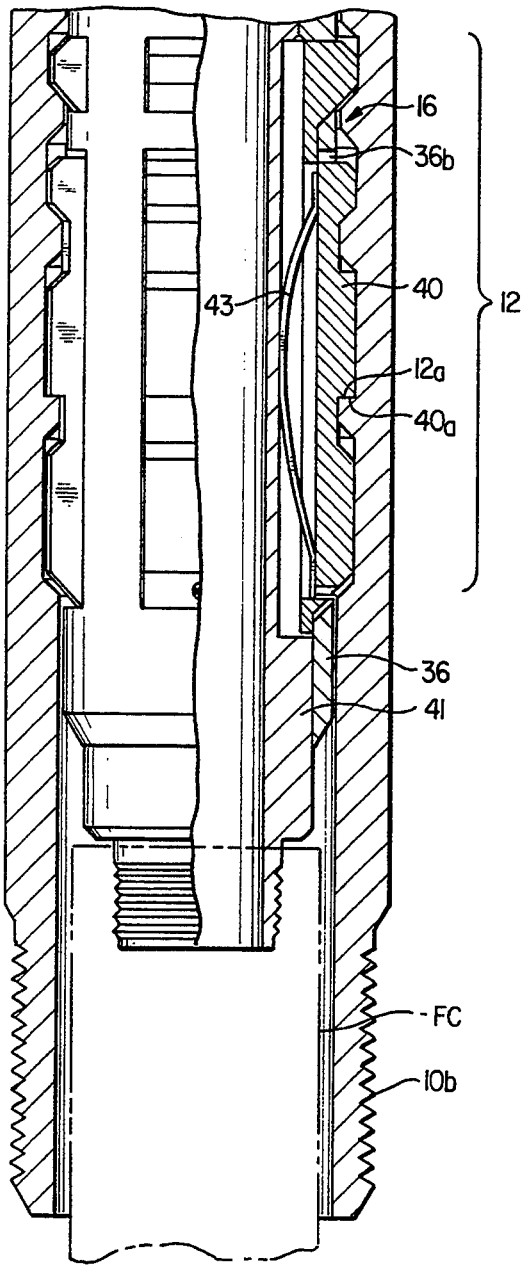
Figure 4:
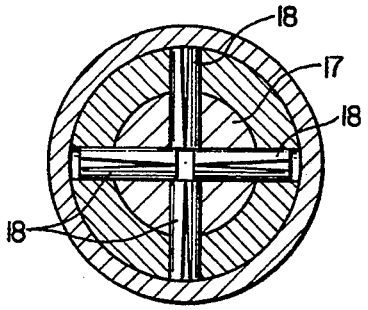
FIG. 4 is another cross sectional drawing along line 4—4 in FIG. 1.

Shown in FIGS. 1A, 1B and 1C is a full bore landing nipple 10, having connectors at **10*a* and 10*b* for connection into a well flow conduit. The landing nipple includes a locking groove 11 and profiled locating recesses 12 having a square shoulder 12*a* facing upwardly. Twenty or more full bore landing nipples may be spaced apart and connected in a well flow conduit as it is installed in a well. A flow control FC has been connected to lock mandrel assembly 14. The lock mandrel includes a seal system 15 and a locator assembly 16 and has been releasably attached to a running tool adapter 17 by frangible pins 18 (see also FIG. 4**). The running tool adapter has been connected to a running tool (not shown) for lowering the lock mandrel downwardly in the well conduit to locate, seal and lock in a compatible full bore landing nipple.

Figure 3:
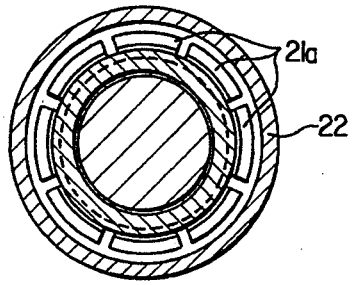
FIG. 3 is the drawing of a cross section along line 3—3 in FIG. 1.
Figure 2:
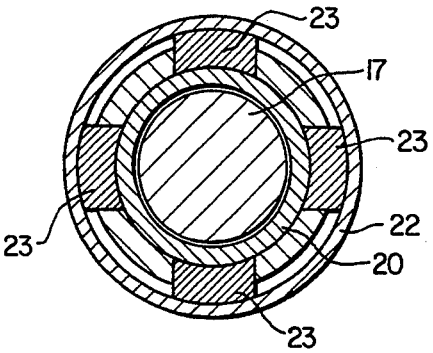
FIG. 2 is a cross sectional drawing along line 2—2 in FIG. 1.

The lock mandrel assembly includes a fishing neck 19 connected to an expander 20, which is slidably mounted around the run tool adapter and has a larger diameter portion **20*a* and a shoulder 20*b*. A ratchet collet 21 having flexible internally grooved fingers 21*a* is positioned in housing 22, which has an internal groove 22*a* and a shoulder 22*b* (see also FIG. 3). The collet has a number of openings 21*b* in which radially moveable lugs 23 are mounted as also shown in FIG. 2. Lug expander 20 is releasably positioned in the housing by pins 24 and props the lugs into engagement in housing groove 22***a*, releasably connecting the collet and housing. A lock ring 25 around the collet is positioned upwardly compressing spring 26 as the collet fingers are held "flared" (slightly tapered downwardly and outwardly) because there is no groove at the lower end of collet fingers 21*a*. The ratchet mandrel 27 has external grooves engageable with the collet finger internal grooves when aligned and is releasably positioned in the housing by pins 28.

Figure 5:
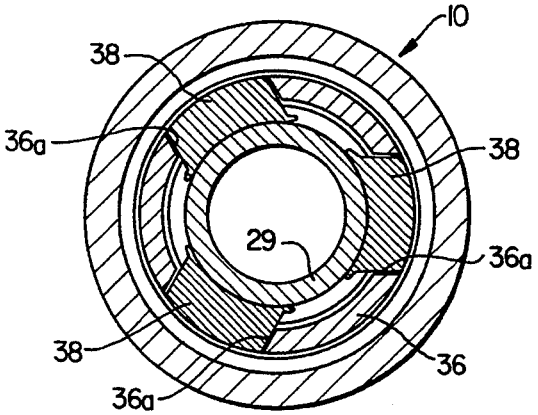
FIG. 5 is also a drawing of a cross section taken along line 5—5 in FIG. 1.
Figure 8A:
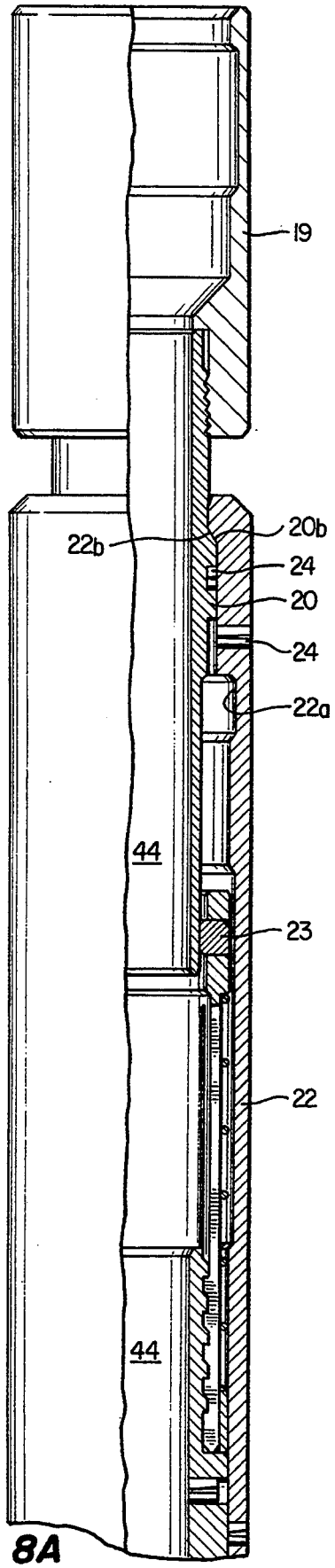
FIGS. 8A, 8B and 8C show the invention system in which the lock mandrel is unlocked, seal system has retracted and the lock mandrel is being retrieved from the landing nipple.
Figure 8B:
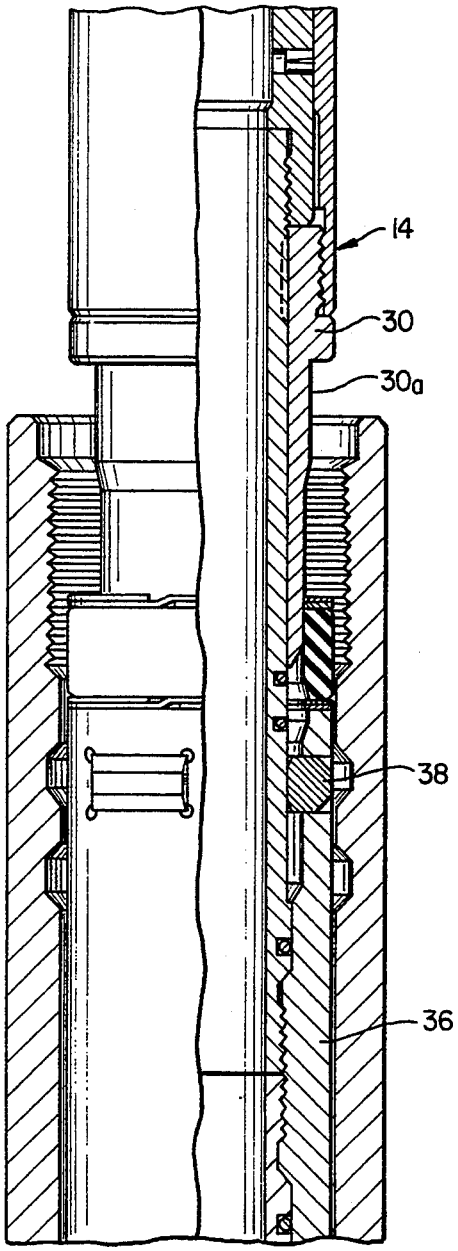
Figure 8C:
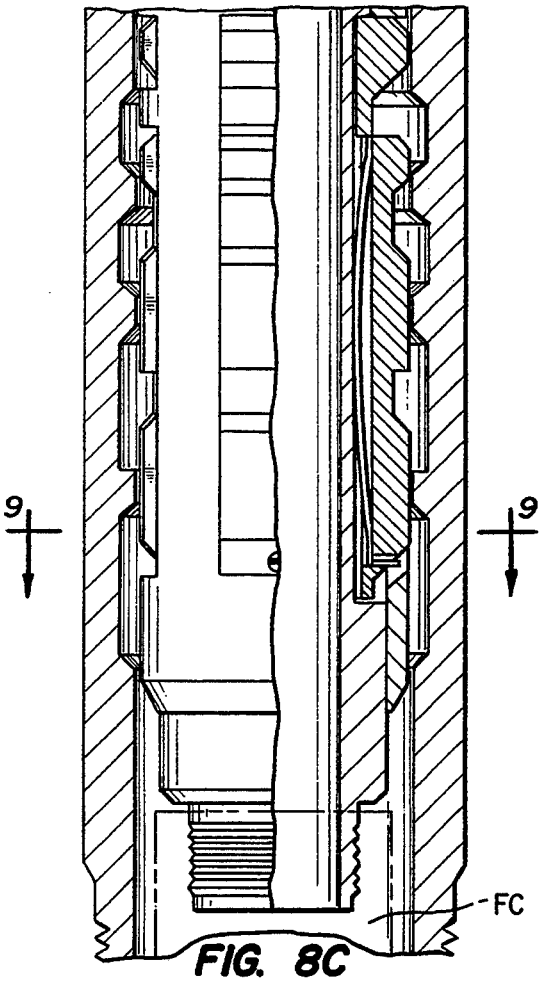
Figure 9:
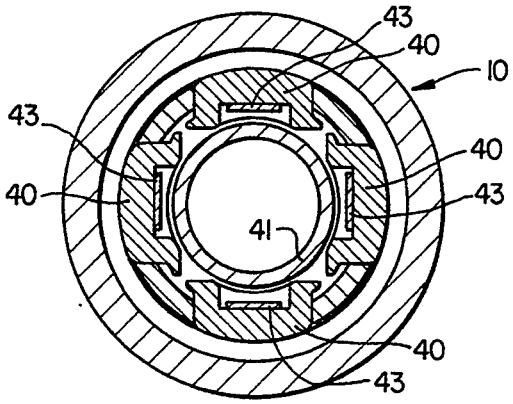
FIG. 9 is a cross-section along line 9—9 in FIG. 8.

An upper mandrel 29 is connected to the lower end of ratchet mandrel with lug seal expander 30 slidably mounted around the upper mandrel and connected to the lower end of housing 22. Seal system 15 is positioned around expander 30 and includes elastomer seal element 31 with expandable anti-extrusion rings 32. Expander 30 has a larger diameter portion 30*a*, a camming surface 30*b* and is sealed to mandrel 29 with seal 33. The lower anti-extrusion ring abuts the top of key retainer 36, which has upper and lower openings 36*a* and 36*b* and is connected and sealed to mandrel 29 with seal 37. Mounted for radial movement in openings 36*a* are locking lugs 38 (see FIG. 5). Each lug is engageable in full bore landing nipple locking groove 11. Retractable profiled locating keys 40 are mounted for radial movement in lower key retainer openings 36*b*. These keys are profiled to engage profiled landing nipple recesses 12 and each has a downwardly facing square shoulder 40*a* which is engageable with landing nipple upwardly facing square shoulder 12*a*. A lower mandrel 41 is connected and sealed to key retainer 36 with seal 42. Leaf springs 43 bias the locator keys outwardly to engage locating recesses 12. Lock mandrel 14 has a through flow passage 44 when adapter 17 is removed—see FIG. 8.

Figure 6A:
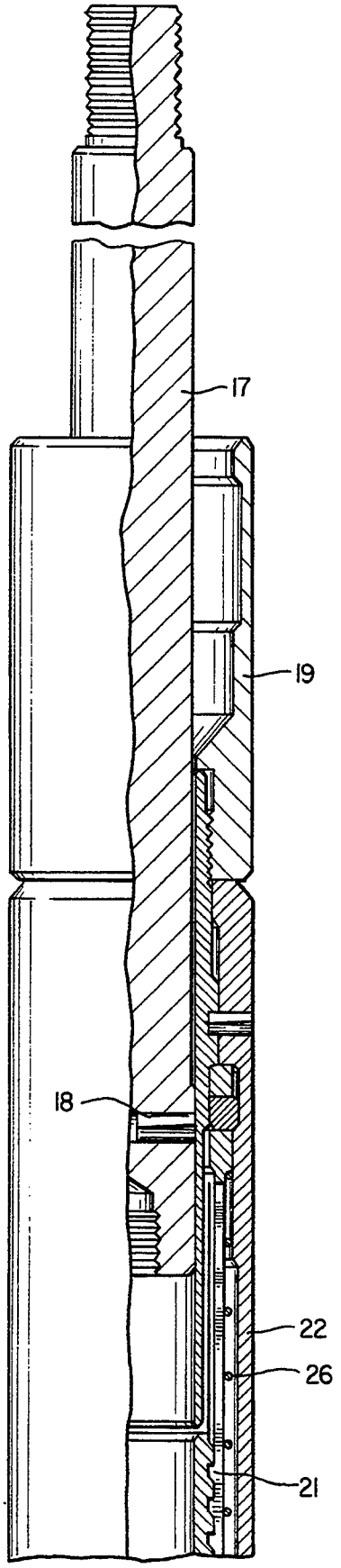
FIGS. 6A, 6B and 6C are a drawing in elevation and half section of the invention lock mandrel, with attached flow control, locked and sealed in the invention landing nipple.
Figure 6B:
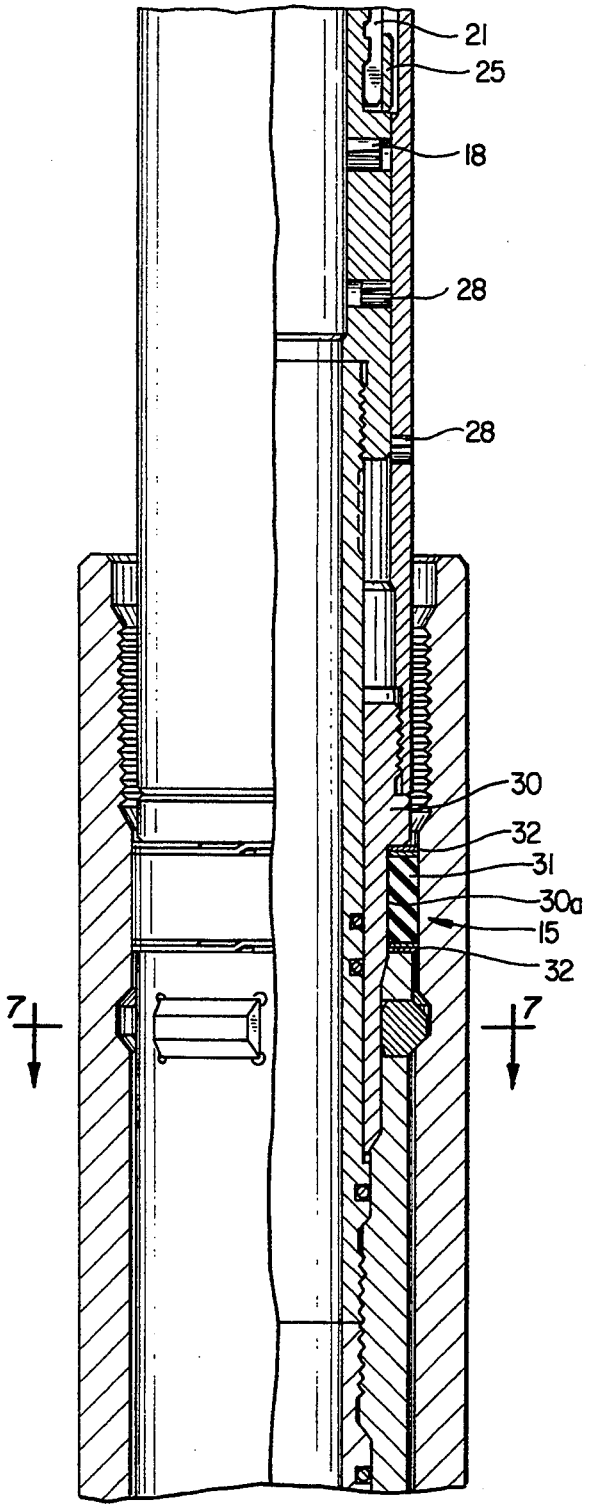
Figure 6C:
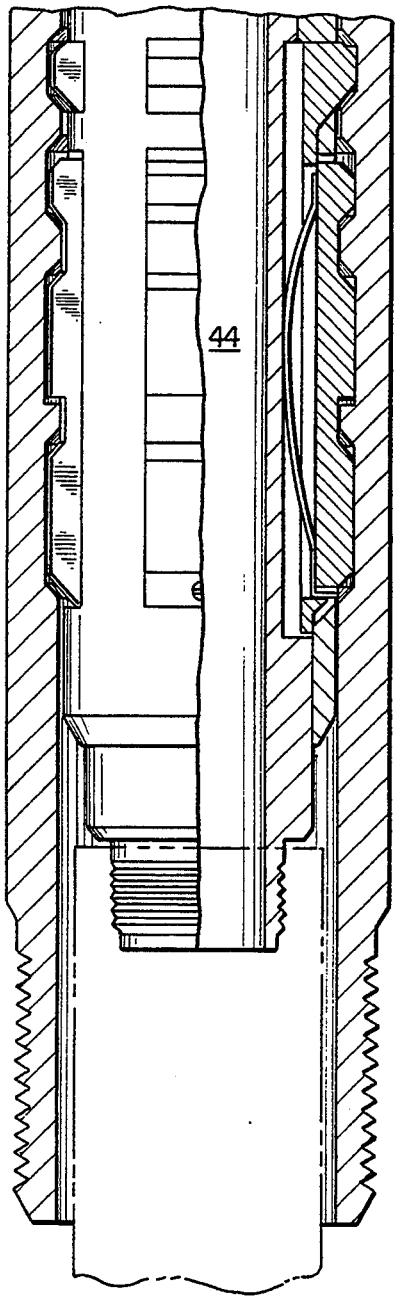

Any one of a number of flow controls FC, such as safety valves, injection valves, equalizing valves or other flow control devices may be connected on the lower end of mandrel 41 in lock mandrel 14. Run tool adapter 17 is connected to an appropriate running tool and lock mandrel 14 is positioned on the adapter with pins 18. The running tool with lock mandrel and flow control is lowered into a well conduit until the locating assembly keys are moved outwardly into compatible profiled locating recesses 12 in the landing nipple and key square shoulders 40a contact landing nipple square shoulder 12*a*, stopping downward motion of the lock mandrel and running tool and "locating" the lock mandrel in a landing nipple. The running tool may now be operated to expand the sealing system into sealing engagement with the landing nipple and lock the lock mandrel in the landing nipple and control flow from below the flow control into mandrel flow passage 44 as shown in FIGS. 6A, 6B and 6C.

Figure 7:
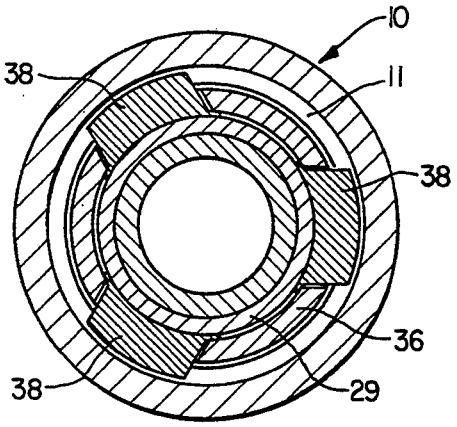
FIG. 7 is a cross sectional drawing along line 7—7 of FIG. 6.

After the lock mandrel locates in a landing nipple, downward force from the running tool on fishing neck 19 shears pins 28 and moves the fishing neck, housing 22, ratchet collet 21 and expander 30 downwardly while grooves in collet fingers 21*a* "ratchet" downwardly over ratchet mandrel 27 grooves. Downward movement of the expander cams lugs 38 outwardly to engage locking groove 11 (see also FIG. 7) and expander larger diameter 30*a* inside seal system 15 expanding anti-extrusion rings 32 into contact with and seal 31 into sealing engagement with landing nipple 10. After collet 21 ratchets all the way down over mandrel 27 and the collet fingers move inwardly, spring 26 extends moving ring 25 down, locking the collet in place on the mandrel—see FIGS. 6A and 6B. FIG. 6A shows adapter 17 (which is connected to the running tool) has been moved upwardly shearing pins 18 for retrieval of the running tool and adapter back to surface. Removal of the running tool and adapter opens flow passage 44 (FIGS. 8A, 8B and 8C) completely for flow through flow control FC and lock mandrel 14 into the well conduit above.

To retrieve lock mandrel 14 and flow control FC from landing nipple 10, fishing neck 19 is engaged by an appropriate pulling tool (not shown) which has been lowered through the well conduit. Sufficient upward force is applied to the pulling tool, fishing neck and lug expander 20 to shear pins 24 and move larger diameter portion 20*a* upwardly from inside lugs 23. Continued upward movement of expander 20 moves a smaller expander diameter portion inside lugs 23, permitting the lugs to disengage housing grooves 22*a* and lug seal expander 30 to be moved upwardly until shoulder 20*b* on expander 20 contacts shoulder in 22*b* housing 22. Movement of expander 30 from inside lugs 38 will permit the lugs to be retracted and movement of larger diameter 30*a* from inside seal system 15 permits anti-extrusion rings 32 and seal 31 to retract from sealing engagement with the full bore landing nipple.

Continued upward pull on the fishing neck has moved expander 30 upward until the expander contacted ratchet mandrel 27. Now, lifting lock mandrel 14 and key retainer 36 will cam lugs 38 and locating keys 40 inwardly from full bore landing nipple groove 11 and profiled locating recesses 12 (see FIGS. 8A, 8B, 8C and 9). The lock mandrel with flow control may now be lifted and retrieved from the landing nipple back to surface.

Figure 10:
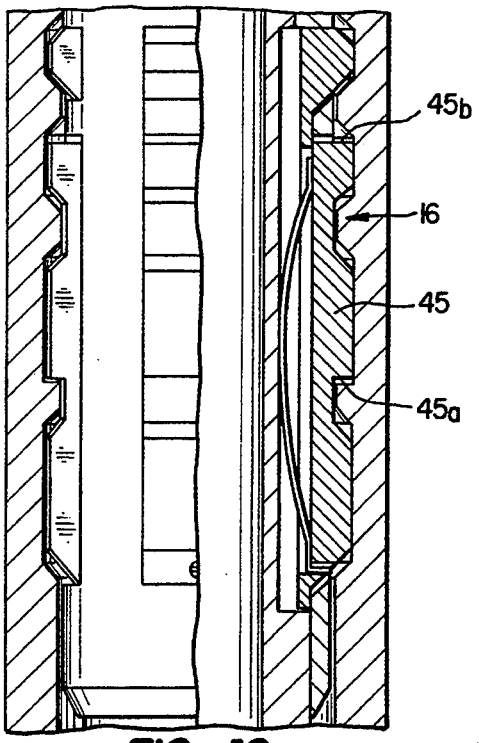
FIG. 10 is a drawing of a portion of FIG. 6 showing locating keys with two square shoulders on the lock mandrel locator assembly.

Alternate profiled locating keys 45 shown in FIG. 10, which have downwardly facing square shoulders 45*a* and upwardly facing square shoulders 45*b*, may be utilized on the locator assembly 16 if required and not change the operation of the invention lock mandrel or system.

What is claimed is:

1. A locking system comprising:

(a) a landing nipple connectable in a well flow conduit, said landing nipple having an unrestricted longitudinal flow passage therethrough and a locking groove and profiled locating recesses in said flow passage said locating recesses having one square shoulder; and (b) a lock mandrel to which flow control devices are connectable, said lock mandrel including:

an upper mandrel and a lower mandrel, releasable means on said upper mandrel for locking in said landing nipple locking groove, said locking means including a number of lugs engageable in said landing nipple locking groove, retractable, mechanically actuated sealing system means on said upper mandrel for expanding into sealing engagement with said landing nipple, retractable locating means on said lower mandrel for automatically engaging said nipple locating recesses, said locating means having profiled locating keys with one square shoulder, means therein for retaining said lock mandrel locked and sealed in said landing nipple, and releasable means for releasing said lock mandrel to unlock and permit said sealing system means to retract.

2. The locking system according to claim 1 wherein the square shoulder on the profiled locating recesses faces upwardly and the profiled locating keys have a downwardly facing square shoulder engagable by said square shoulder in said locating recesses.

3. The locking system according to claim 1 wherein the square shoulder in the profiled locating recesses faces upwardly and the profiled locating keys have upwardly and downwardly facing square shoulders, said locating key downwardly facing square shoulder engagable with said square shoulder in said locating recesses.

4. The locking system of claim 1 wherein the releasable means on the upper mandrel for locking in the landing nipple groove comprises:

(a) a key retainer having upper and lower openings therein, said key retainer connecting the upper and lower mandrels together;

(b) a locking lug mounted for radial movement in each said upper opening; and (c) a lug seal expander slidably mounted around said upper mandrel for moving said lugs outward to engage said landing nipple locking groove and expanding the sealing system means.

5. The locking system of claim 1 wherein the lock mandrel retractable sealing system means comprises:

(a) an upper expandable anti-extrusion ring;

(b) an expandable elastomer seal;

(c) a lower expandable anti-extrusion ring; and (d) a lug seal expander having a larger diameter portion for expanding said anti-extrusion rings and seal.

6. The locking system of claim 5 wherein the lock mandrel seal system anti-extrusion rings are metal and are spiral wound having at least one coil.

7. The locking system of claim 4 wherein the lock mandrel locating means comprises:

(a) a profiled locating key mounted for radial movement in each key retainer lower opening, each said key having a downwardly facing square shoulder; and (b) springs between the lower mandrel and said keys biasing said keys outwardly.

8. The locking system of claim 1 wherein the means for retaining the lock mandrel locked and sealed in the landing nipple comprises:

(a) a housing connected on a lug seal expander;

(b) a ratchet mandrel having external grooves, said ratchet mandrel connected on the upper mandrel;

(c) a collet with a number of fingers, said fingers having internal grooves engageable with said ratchet mandrel external grooves;

(d) releasable means for positioning said collet in said housing; and (e) means for holding said collet engaged with said ratchet mandrel.

9. The locking system of claim 8 wherein the releasable means positioning the collet in the housing comprises:

(a) an internal groove in said housing;

(b) openings in said collet;

(c) a lug mounted for radial movement in each said collet opening;

(d) a lug expander slidably mounted and releasably positioned in said housing, said lug expander having a larger diameter portion for holding said lugs radially outward and engaged in said housing internal groove.

10. The locking system of claim 8 wherein the means for holding the collet engaged with the ratchet mandrel comprises:

(a) a spring around the collet fingers; and (b) a lock ring slidably mounted around said collet fingers.

11. A lock mandrel having locating means with one square shoulder, said lock mandrel operable to locate, releasably lock and sealingly engage a compatible landing nipple having an unrestricted flow passage therethrough, said lock mandrel comprising:

(a) upper and lower connected mandrels;

(b) locator means on said lower mandrel for automatically locating in said landing nipple;

(c) releasable locking means on said upper mandrel for locking said lock mandrel in said landing nipple; and (d) retractable, mechanically actuated seal system means on said upper mandrel for expanding and sealingly engaging said landing nipple.

12. The lock mandrel of claim 11 further including means for retaining said lock mandrel locked and sealed in a compatible unrestricted landing nipple having one square shoulder.

13. The lock mandrel of claim 12 further including releasable means for releasing said lock mandrel to unlock and permit said sealing system means to retract.

14. A lock mandrel having locating means with two square shoulders, said lock mandrel operable to locate, releasably lock and sealingly engage a compatible landing nipple having an unrestricted flow passage therethrough, said lock mandrel comprising:

(a) upper and lower connected mandrels;

(b) locator means on said lower mandrel for automatically locating in said landing nipple;

(c) releasable locking means on said upper mandrel for locking said lock mandrel in said landing nipple; and (d) retractable, mechanically actuated seal system means on said upper mandrel for expanding and sealing engaging said landing nipple.

15. The lock mandrel of claim 14 further including means for retaining said lock mandrel locked and sealed in a compatible unrestricted landing nipple having one square shoulder.

16. The lock mandrel of claim 15 further including releasable means for releasing said lock mandrel to unlock and permit said sealing system means to retract.

17. A locking system comprising:

(a) a landing nipple connectable in a well flow conduit, said landing nipple having an unrestricted longitudinal flow passage therethrough and a locking groove and profiled locating recesses with one square shoulder in said flow passage; and (b) a lock mandrel to which flow control devices are connectable, said lock mandrel including:

an upper mandrel;

means on said upper mandrel for locking in said nipple locking groove, said locking means including, a key retainer having upper and lower openings, a locking lug mounted for radial movement in each said key retainer upper opening, retractable sealing system means on said upper mandrel for expanding into sealing engagement with said landing nipple, said sealing system means including, an upper expandable anti-extrusion ring, an expandable elastomer seal, a lower expandable anti-extrusion ring, a lug seal expander slidably mounted around said upper mandrel for moving and holding said lugs outward and engaged in said landing nipple locking groove and expanding the sealing system means, said lug seal expander having a larger diameter portion for expanding said anti-extrusion rings and seal;

locating means for automatically engaging said nipple locating recesses, said locating means including:

a lower mandrel connected to said upper mandrel by said key retainer, a profiled locating key having one downwardly facing square shoulder mounted for radial movement in each said lower key retainer opening, springs between said lower mandrel and said locating keys biasing said keys outwardly; and means for retaining said lock mandrel locked and sealed in said landing nipple, said means for retaining said lock mandrel locked and sealed including, a housing connected on said lug seal expander, a ratchet mandrel having external grooves, said ratchet mandrel connected on said upper mandrel, a collet having internal grooves engageable with said ratchet mandrel external grooves; and releasable means for releasing said lock mandrel to unlock and permit said sealing system means to retract, said releasable means including, an internal groove in said housing, openings in said collet, a lug mounted for radial movement in each said collet opening;

a lug expander slidably mounted and releasably positioned in said housing, said lug expander having a larger diameter portion for holding said lugs radially outward and engaged in said housing internal groove.

* * * * *